US009260973B2

(12) United States Patent
Petersen

(10) Patent No.: US 9,260,973 B2
(45) Date of Patent: Feb. 16, 2016

(54) FAN BLADE ADJUSTMENT PIEZOELECTRIC ACTUATOR

(71) Applicant: United Technologies Corporation, Hartford, CT (US)

(72) Inventor: Brandon M. Petersen, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 662 days.

(21) Appl. No.: 13/731,136

(22) Filed: Dec. 31, 2012

(65) Prior Publication Data

US 2014/0186200 A1 Jul. 3, 2014

(51) Int. Cl.
*F01D 7/00* (2006.01)
*F04B 17/00* (2006.01)

(52) U.S. Cl.
CPC ..... *F01D 7/00* (2013.01); *F04B 17/003* (2013.01); *F05D 2260/76* (2013.01)

(58) Field of Classification Search
CPC ..... F01D 7/00; F04B 17/003; F04B 43/046; F04B 43/095; F05D 2260/76
See application file for complete search history.

(56) References Cited

U.S. PATENT DOCUMENTS 4,930,608 A 6/1990 Schenk et al.
5,174,716 A * 12/1992 Hora ..... B64C 11/32 416/129
5,353,839 A * 10/1994 Kordonsky ..... F15B 21/065 137/806
5,997,127 A 12/1999 Fassler et al.

* cited by examiner

*Primary Examiner* — Richard Edgar
*Assistant Examiner* — Brian O Peters
(74) *Attorney, Agent, or Firm* — Carlson, Gaskey & Olds, PC

(57) ABSTRACT

A pump for driving a hydraulic fluid to adjust an angle of an airfoil has a transmission to be rotated to change the angle of incident of a plurality of airfoils. The transmission is driven through a rotating input to in turn rotate, and change the angle. The input is caused to rotate by a piston having engaging threads on the input, and the piston is mounted within a hydraulic chamber. Opposed chambers are on each of two opposed ends of the piston. A piezoelectric pump selectively delivers pressurized fluid into the opposed chambers to drive the piston, and to in turn cause the input to rotate.

11 Claims, 4 Drawing Sheets

FAN BLADE ADJUSTMENT PIEZOELECTRIC ACTUATOR

BACKGROUND OF THE INVENTION

This application relates to an adjustable fan blade wherein the angle of incident of the fan blade may be changed utilizing a piezoelectric actuator.

Gas turbine engines are known, and typically include a fan delivering air into a compressor section. The air is compressed and moved downstream into a combustion section where it is mixed with fuel and ignited. Products of this combustion pass downstream over a turbine section, driving turbine rotors to rotate. The turbine rotors in turn rotate the compressor rotors and the fan.

Traditionally, a turbine rotor drove a compressor rotor and the fan rotor at one speed. However, more recently, a gear reduction has been incorporated between the turbine rotor and the fan such that the fan can rotate at a lower speed than the turbine rotor. This has resulted in a great deal of design freedom for the fan.

It has become desirable to make the fan rotor and blades much larger radially. The fan typically delivers a portion of air into a bypass duct as propulsion air along with the air that is delivered into the compressor.

For any number of reasons it becomes desirable to adjust the pitch of the fan blades such that they may be at different angles during different periods of operation. An adjustment ring has typically been rotated, and as it rotates it cams the fan blades to change their angle. Historically, electric motors, or other relatively large mechanical actuators have been utilized.

SUMMARY OF THE INVENTION

In a featured embodiment, a system has a transmission to be rotated to change a pitch angle of a plurality of airfoils. The transmission is driven through a rotating input to in turn rotate, and change the angle. The input is caused to rotate by a piston having threads engaging threads on the input. The piston is mounted within a hydraulic housing, and has opposed chambers on each of two opposed ends of the piston. A piezoelectric pump selectively delivers fluid into the opposed chambers to drive the piston, and to in turn cause the input to rotate.

In another embodiment according to the previous embodiment, the piezoelectric pump includes a piezoelectric stack which may be excited to cause the pump to drive fluid into one of the chambers to in turn move the piston.

In another embodiment according to any of the previous embodiments, the piston has threads at both an inner and outer periphery. One of the inner and outer periphery engages threads on the input, and the other engages threads on the housing such that the piston is caused to translate axially, but also rotate, and the input is caused to rotate.

In another embodiment according to any of the previous embodiments, a mechanical transmission transmits rotation of the input into rotation of the transmission.

In another embodiment according to any of the previous embodiments, a valving system is connected between the piezoelectric pump and the opposed chambers.

In another embodiment according to any of the previous embodiments, the valving system includes a first valve that blocks communication between a first of the opposed chambers and a supply line from the pump. A second valve blocks communication between a second of the opposed chambers and the supply line. A third valve selectively blocks communication of the first of the opposed chambers and a return line to the pump. A fourth valve selectively blocks communication between the second of the chambers and the return line. One of the first and third valves is opened and the other is closed. One of the second and fourth valves is opened and the other is closed such that fluid is communicated from the supply line to one of the opposed chambers. The return line is communicated to the other of the opposed chambers to drive the piston.

In another embodiment according to any of the previous embodiments, the four valves are provided by a coil which selectively communicates a magnetic field into a valve chamber to selectively block flow of fluid.

In another embodiment according to any of the previous embodiments, a fluid is driven by the pump into the opposed chambers is a magnetorheological fluid, such that the magnetic field will block flow through the valve.

In another embodiment according to any of the previous embodiments, the transmission includes a ring that rotates to change the angle.

In another featured embodiment, a system has a ring to be rotated to change a pitch angle of a plurality of airfoils. The ring is driven through a rotating input to in turn rotate and change the angle. The input is caused to rotate by a piston having threads engaging threads on the input. The piston is mounted within a hydraulic housing, and has opposed chambers on each of two opposed ends of the piston. A piezoelectric pump selectively delivers fluid into the opposed chambers to drive the piston, and to in turn cause the input to rotate. The piezoelectric pump includes a piezoelectric stack which may be excited to cause the pump to drive fluid into one of the chambers to in turn move the piston. The piston has threads at both an inner and outer periphery, with one of the inner and outer periphery engaging threads on the input, and the other engaging threads on the housing such that the piston is caused to translate axially, but also rotate. The input is caused to rotate. A valving system is connected between the piezoelectric pump and the opposed chambers. The valving system includes a first valve that blocks communication between a first of the opposed chambers and a supply line from the pump. A second valve blocks communication between a second of the opposed chambers and the supply line. A third valve selectively blocks communication of the first of the opposed chambers and a return line to the pump. A fourth valve selectively blocks communication between the second of the chambers and the return line. One of the first and third valves is opened and the other is closed. One of the second and fourth valves is opened and the other is closed such that fluid is communicated from the supply line to one of the opposed chambers, and the return line is communicated to the other of the opposed chambers to drive the piston. The four valves are provided by a coil which selectively communicates a magnetic field into a valve chamber to selectively block flow of fluid. The fluid driven by the pump into the opposed chambers is a magnetorheological fluid, such that the magnetic field will block flow through the valve.

In another featured embodiment, a transmission has a housing receiving a piston, and opposed chambers on each of two opposed ends of the piston. A pump delivers fluid into the opposed chambers to drive the piston. A valving system is connected between the pump and the opposed chambers. The valving system includes a first valve that blocks communication between a first of the opposed chambers and a supply line from the pump. A second valve blocks communication between a second of the opposed chambers and the supply line. A third valve selectively blocks communication of the first of the opposed chambers and a return line to the pump. A fourth valve selectively blocks communication between the second of the chambers and the return line. One of the first and third valves is opened and the other is closed. One of said second and fourth valves is opened and the other is closed such that fluid is communicated from the supply line to one of the opposed chambers. The return line is communicated to the other of the opposed chambers to drive the piston. The four valves are provided by a coil which selectively communicates a magnetic field into a valve chamber to selectively block flow of fluid. A fluid driven by the pump into the opposed chambers is a magnetorheological fluid, such that the magnetic field will block flow through the valve.

These and other features may be best understood from the following specification and drawings, the following which is a brief description.

DETAILED DESCRIPTION

Figure 1:
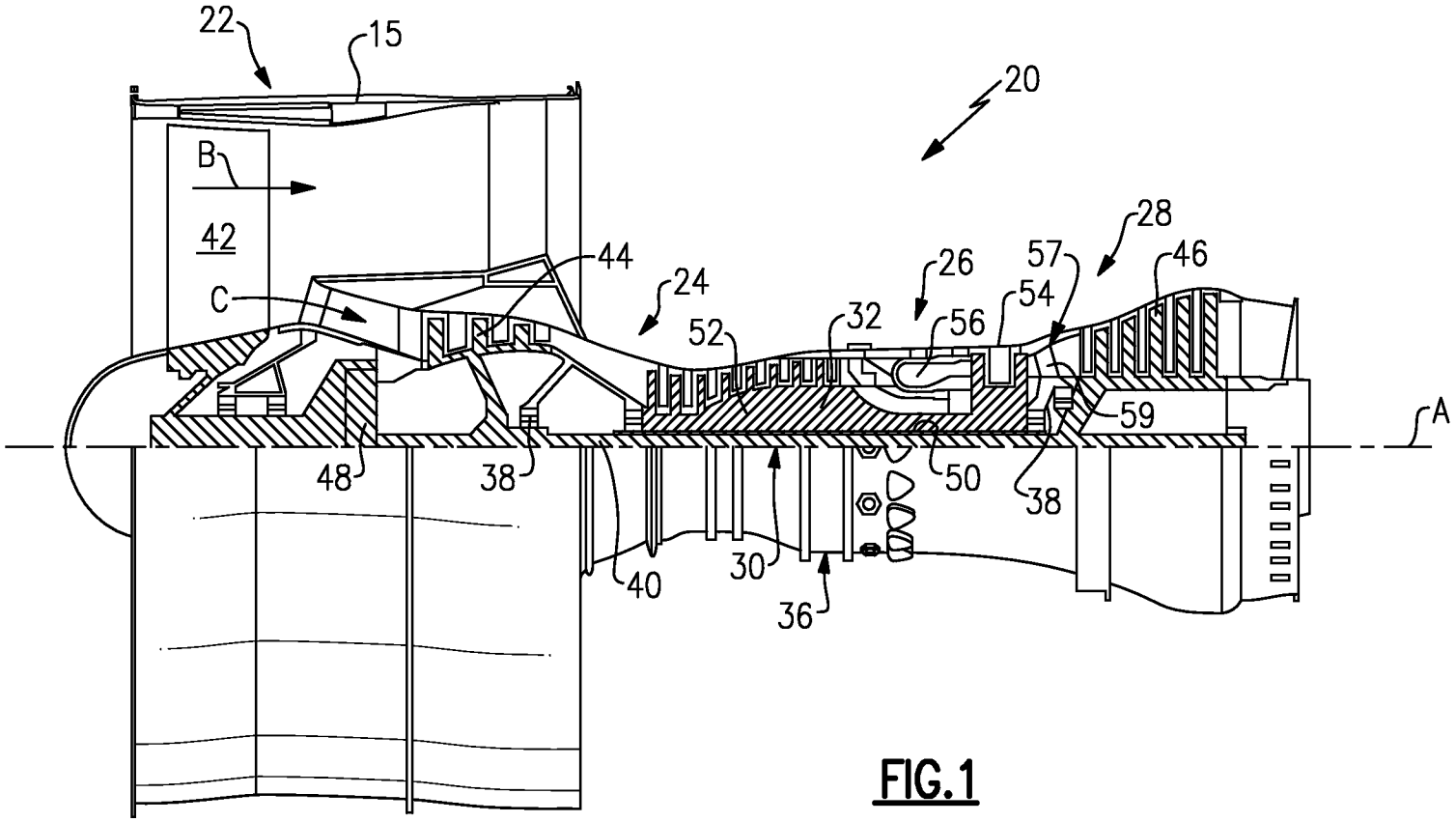
FIG. 1 shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\,^\circ\text{R})/(518.7^\circ\text{R})]^{0.5}$. The "Low corrected fan tip speed" as disclosed herein according to one non-limiting embodiment is less than about 1150 ft/second.

Figure 2A:
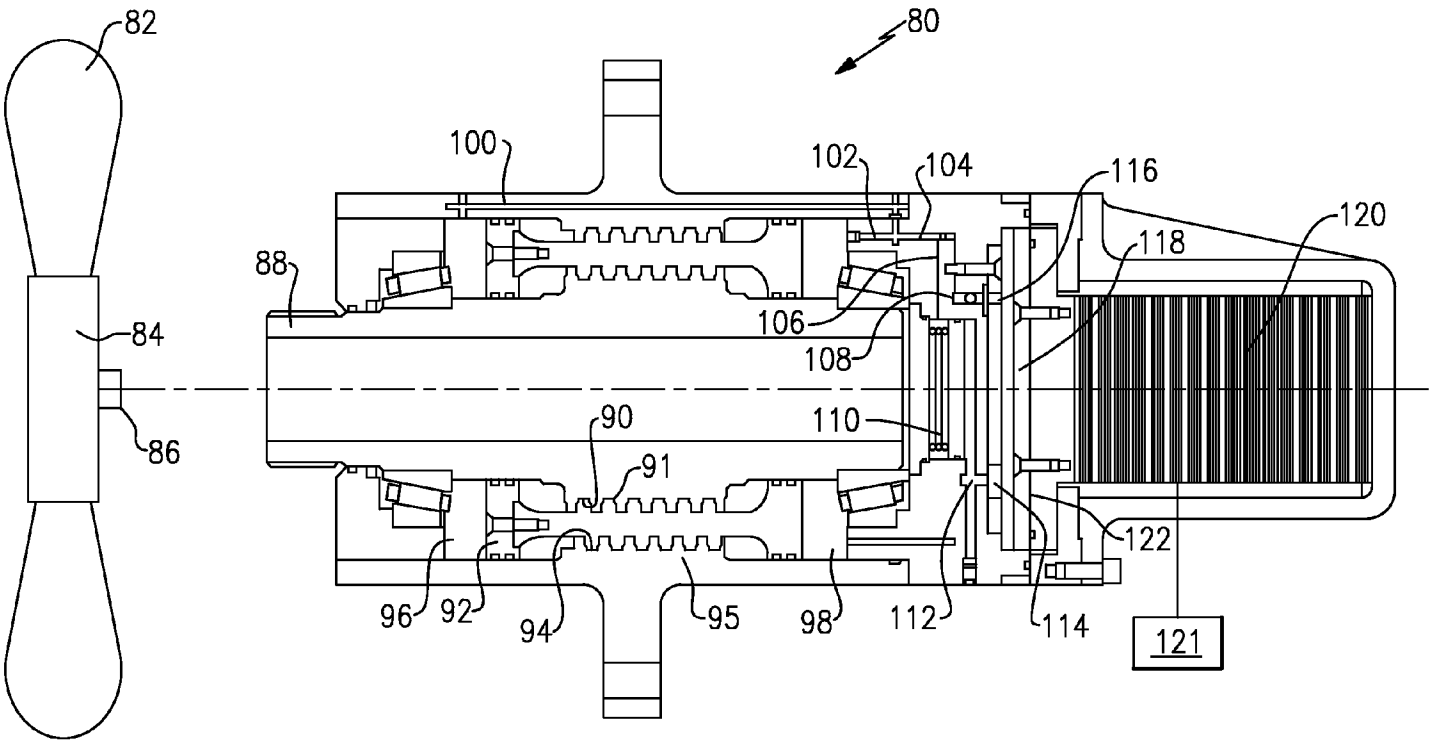
FIG. 2A shows an actuator.

FIG. 2A shows an actuator 80 for changing a pitch angle of the fan blades 82. This could be incorporated into the fan 22 of the gas turbine engine 20 of FIG. 1. The fan blades 82 are received within an adjustment ring 84 which may be rotated to change the angle of incident of the fan blades.

Figure 2B:
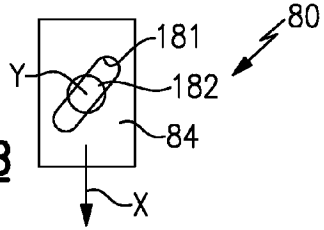
FIG. 2B schematically shows the adjustment of a fan blade.

As shown for example in FIG. 2B, a slot 181 in the ring 184 will cam a portion 182 that is fixed to the fan blade 82 to change the angle of an airfoil. This aspect of the application is as known.

A mechanical transmission 86 of some sort translates rotation of an input 88 into the rotation of the ring 84. A worker of ordinary skill in the art would recognize that any number of transmissions could be utilized as the transmission 86. Some other drive (see FIG. 1) drives the fan rotor.

An input 88 is driven by a piezoelectric pump, as will be explained below. The input 88 has threads 90 at an outer periphery which engage threads 91 on a piston 92. The threads 91 are also received in threads 94 in an outer housing 95. The housing 95 and piston 92 define opposed chambers 96 and 98 which receive a hydraulic fluid to drive the piston between the left and right as shown in FIG. 2A. As can be appreciated, due to the threads 90, 91 and 94, as the piston translates between the left and right positions it will rotate, but it will also drive the input 88 to rotate. Input 88 is constrained from axial movement.

A passage 100 delivers hydraulic fluid into the chamber 96, and passage 102 delivers the fluid into the chamber 98. A passage 104 communicates with both passages 102 and 100, and also communicates with a passage 106 that leads to an accumulator 110. The passage 104 also communicates with an inlet passage 108 which communicates with an output check valve 116. The accumulator 110 communications with an input check valve 114 through a passage 112. The operation of the valves will be explained below with reference to FIGS. 3A and 3B.

A pump chamber 118 communicates with the check valves 114 and 116. The position of a diaphragm 122 is changed by excitation of a piezoelectric stack 120. The piezoelectric stack is driven by a control, shown schematically at 121.

When it is desired to change the angle of the fan blades 82, the piezoelectric stack 120 is excited, and as it is excited it pumps fluid by driving the diaphragm 122 to the left or withdrawing the diaphragm 122 to the right. When the diaphragm 122 moves to the right fluid is brought in through the check valve 114 from the accumulator 110. When the diaphragm 122 is driven to the left fluid is driven outwardly through the outlet check valve 116.

Utilizing a pump formed by a piezoelectric stack 120 provides a very efficient and compact drive mechanism for driving the hydraulic fluid into the chambers 96 and 98.

Figure 2C:
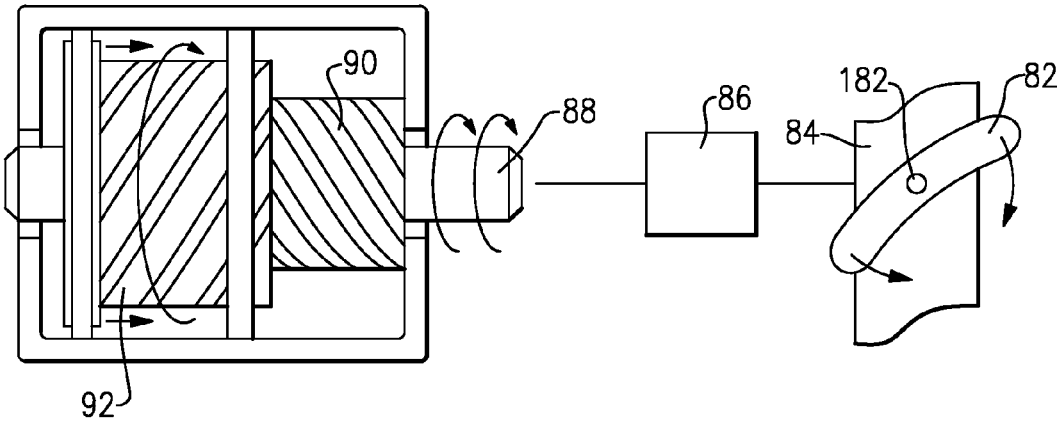
FIG. 2C shows a drive arrangement.

FIG. 2C shows the piston 92 driving the threads 90 to in turn cause the input 88 to rotate. This causes the mechanical transmission 86 to cause the ring 84 to rotate, and causes the angle of incident of the airfoil associated with the fan blade 82 to change as shown schematically in FIG. 4.

Figure 3A:
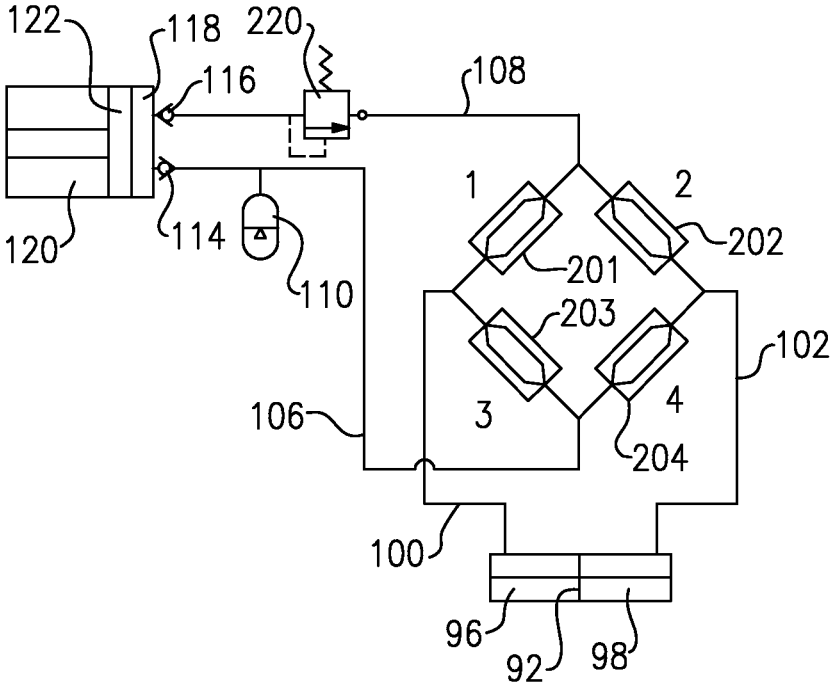
FIG. 3A shows a hydraulic flow diagram.
Figure 3B:
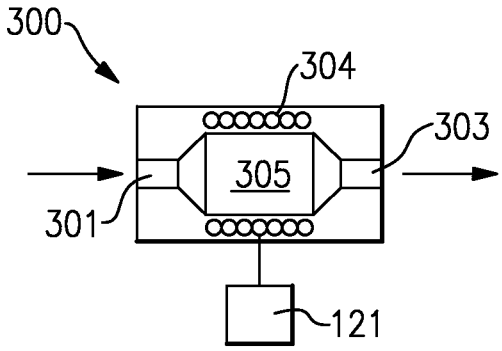
FIG. 3B shows a detail of the FIG. 3B circuit.

FIG. 3A shows the hydraulic circuit for communicating the pump chamber 118 to the hydraulic chambers 96 and 98.

Fluid from output check valve 116 passes through a pressure relief valve 220, and then approaches four valves 201, 202, 203 and 204 through a line 108.

An output line 106 returns to the accumulator 110 and the input check valve 114. The lines 106 and 108 are selectively communicated through the passages 100 and 102 to the chambers 96 and 98 dependent on the direction of rotation desired for adjustment of the blades 82.

Now, the operation of the check valves 201, 202, 203, and 204 will be explained. Each of the check valves is structured as shown at 300 in FIG. 3B. An input line 301 and an output line 303 communicate the fluid as desired to one of the passages. A coil 304 is selectively powered by the control 121 to control whether the valve 300 allows flow or blocks flow.

The fluid utilized by the pump and the hydraulic circuit of FIG. 3A is a magnetorheological fluid. Such fluids are known, and are a semi-active smart material where a rheological behavior of the fluid can be alternated by applying a magnetic field. By applying a current across the coil 304, an electromagnetic field is passed into the chamber 305 within the valve 300. When a strong field is applied, the fluid will not flow from the input 301 to the output 303. Thus, when it is desired to pass fluid into the passage 100 to the chamber 96, then the valve 203 is supplied with current to its coil 304 to block the flow into the passage 106, and the valve 201 is not actuated. At the same time, the piezoelectric stack 120 is actuated to drive fluid into the passage 108, through the valve 201 to the passage 106 and into chamber 96.

At the same time, the valve 202 is actuated to block communication between the passage 108 and the passage 102. The valve 204 is not actuated. Thus, the fluid is being driven into the chamber 96, and the piston 92 will move to the right as shown in FIG. 3A. Fluid will also pass from the chamber 98, through the passage 102, the valve 204, and to the passage 106 back to accumulator 110 and input check valve 114.

When desired to move the piston in the opposed direction, the order of actuation is of course reversed.

While a particular valving construction has been disclosed, it should be understood that the pump structure of FIG. 2A could be utilized with more simple, or other types of valving structure.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A system comprising:

a transmission to be rotated to change a pitch angle of a plurality of airfoils;

said transmission being driven through a rotating input to in turn rotate, and change the angle;

said input being caused to rotate by a piston having threads engaging threads on said input, and said piston being mounted within a hydraulic housing, and having opposed chambers on each of two opposed ends of said piston; and a piezoelectric pump for selectively delivering fluid into said opposed chambers to drive said piston, and to in turn cause said input to rotate.

2. The system as set forth in claim 1, wherein said piezoelectric pump includes a piezoelectric stack which may be excited to cause the pump to drive fluid into one of said chambers to in turn move said piston.

3. The system as set forth in claim 1, wherein said piston has threads at both an inner and outer periphery, with one of said inner and outer periphery engaging threads on said input, and the other engaging threads on the housing such that said piston is caused to translate axially, and also rotate, and said input is caused to rotate.

4. The system as set forth in claim 1, wherein a mechanical transmission transmits rotation of said input into rotation of said transmission.

5. The system as set forth in claim 1, wherein a valving system is connected between said piezoelectric pump, and said opposed chambers.

6. The system as set forth in claim 5, wherein said valving system includes a first valve that blocks communication between a first of said opposed chambers and a supply line from said pump, a second valve that blocks communication between a second of said opposed chambers and said supply line, a third valve that selectively blocks communication of said first of said opposed chambers and a return line to said pump, and fourth valve which selectively blocks communication between said second of said chambers and said return line, wherein one of said first and third valves being opened and the other being closed, and one of said second and fourth valves being opened and the other being closed such that fluid is communicated from said supply line to one of said opposed chambers, and the return line is communicated to the other of said opposed chambers to drive said piston.

7. The system as set forth in claim 6, wherein said four valves are provided by a coil which selectively communicates a magnetic field into a valve chamber to selectively block flow of fluid.

8. The system as set forth in claim 7, wherein a fluid being driven by said pump into said opposed chambers is a magnetorheological fluid, such that said magnetic field will block flow through said valve.

9. The system as set forth in claim 1, wherein the transmission includes a ring that rotates to change the angle.

10. A system comprising:

a ring to be rotated to change a pitch angle of a plurality of airfoils;

said ring being driven through a rotating input to in turn rotate, and change the angle;

said input being caused to rotate by a piston having threads engaging threads on said input, and said piston being mounted within a hydraulic housing, and having opposed chambers on each of two opposed ends of said piston;

a piezoelectric pump for selectively delivering fluid into said opposed chambers to drive said piston, and to in turn cause said input to rotate, said piezoelectric pump including a piezoelectric stack which may be excited to cause the pump to drive fluid into one of said chambers to in turn move said piston, and said piston has threads at both an inner and outer periphery, with one of said inner and outer periphery engaging threads on said input, and the other engaging threads on the housing such that said piston is caused to translate axially, and also rotate, and said input is caused to rotate; and a valving system connected between said piezoelectric pump, and said opposed chambers, said valving system including a first valve that blocks communication between a first of said opposed chambers and a supply line from said pump, a second valve that blocks communication between a second of said opposed chambers and said supply line, a third valve that selectively blocks communication of said first of said opposed chambers and a return line to said pump, and fourth valve which selectively blocks communication between said second of said chambers and said return line, wherein one of said first and third valves being opened and the other being closed, and one of said second and fourth valves being opened and the other being closed such that fluid is communicated from said supply line to one of said opposed chambers, and the return line is communicated to the other of said opposed chambers to drive said piston, said four valves are provided by a coil which selectively communicates a magnetic field into a valve chamber to selectively block flow of fluid, and wherein a fluid being driven by said pump into said opposed chambers is a magnetorheological fluid, such that said magnetic field will block flow through said valve.

11. A transmission comprising:

a housing receiving a piston, and having opposed chambers on each of two opposed ends of said piston;

a pump for delivering fluid into said opposed chambers to drive said piston; and a valving system connected between said pump and said opposed chambers, said valving system including a first valve that blocks communication between a first of said opposed chambers and a supply line from said pump, a second valve that blocks communication between a second of said opposed chambers and said supply line, a third valve that selectively blocks communication of said first of said opposed chambers and a return line to said pump, and a fourth valve which selectively blocks communication between said second of said chambers and said return line, wherein one of said first and third valves being opened and the other being closed, and one of said second and fourth valves being opened and the other being closed such that fluid is communicated from said supply line to one of said opposed chambers, and the return line is communicated to the other of said opposed chambers to drive said piston, said four valves are provided by a coil which selectively communicates a magnetic field into a valve chamber to selectively block flow of fluid, and wherein a fluid being driven by said pump into said opposed chambers is a magnetorheological fluid, such that said magnetic field will block flow through said valve.

* * * * *